US009351066B2

(12) United States Patent
Walter et al.

(10) Patent No.: US 9,351,066 B2
(45) Date of Patent: May 24, 2016

(54) EXPANDABLE SPEAKER

(71) Applicant: DesignPoint Industrial Design Studio, Inc., Boxford, MA (US)

(72) Inventors: Cameron Vail Walter, Boxford, MA (US); Glen Vail Walter, Boxford, MA (US)

(73) Assignee: DesignPoint Industrial Design Studio, Inc., Boxford, MA (US)

( * ) Notice: Subject to any disclaimer, the term of this patent is extended or adjusted under 35 U.S.C. 154(b) by 0 days.

(21) Appl. No.: 14/333,977

(22) Filed: Jul. 17, 2014

(65) Prior Publication Data

US 2015/0049895 A1 Feb. 19, 2015

Related U.S. Application Data

(60) Provisional application No. 61/867,350, filed on Aug. 19, 2013.

(51) Int. Cl.

| | |
|---|---|
| ***H04R 1/02*** | (2006.01) |
| ***H04R 1/28*** | (2006.01) |
| *H04R 25/00* | (2006.01) |
| *H04R 5/02* | (2006.01) |

(52) U.S. Cl.

CPC ..... *H04R 1/2811* (2013.01); *H04R 1/02* (2013.01); *H04R 1/028* (2013.01); *H04R 1/2803* (2013.01); *H04R 5/02* (2013.01)

(58) Field of Classification Search

CPC .. H04R 2499/11; H04R 1/025; H04R 1/2811; H04R 2499/15; H04R 9/045; H04R 5/0335; H04M 1/0235; H04M 1/0237; H04M 1/0214; H04M 1/0258; H04M 1/6066; H04M 1/72541

USPC ..... 381/345, 376, 383, 386, 388, 332, 334, 381/370, 371; 181/175–178

See application file for complete search history.

(56) References Cited

U.S. PATENT DOCUMENTS

| | | | | |
|---|---|---|---|---|
| 8,284,972 | B2 * | 10/2012 | Lin | 381/322 |
| D728,520 | S * | 5/2015 | Zhang | D14/216 |
| D728,521 | S | 5/2015 | Zhang | |
| D728,522 | S | 5/2015 | Zhang | |
| D728,525 | S * | 5/2015 | Zhang | D14/216 |

(Continued)

FOREIGN PATENT DOCUMENTS

| | | | |
|---|---|---|---|
| JP | 2007-129539 | A | 5/2007 |
| WO | WO 2013/078916 | A1 | 6/2013 |

OTHER PUBLICATIONS

Notification of Transmittal of the International Search Report and the Written Opinion of the International Searching Authority for PCT/US2014/051037, "Expandable Speaker," mailed Nov. 24, 2014.

(Continued)

*Primary Examiner* — Sunita Joshi

(74) *Attorney, Agent, or Firm* — Hamilton, Brook, Smith & Reynolds, P.C.

(57) ABSTRACT

A speaker apparatus or system with a user selectably expandable chamber is provided. The chamber in its expanded state enhances the speaker's acoustical properties. The chamber in its collapsed (in physical dimension or shape) state provides a thin profile for increased portability or low profile mounted solutions. The speaker is compatible with current electronics.

28 Claims, 23 Drawing Sheets

(56) References Cited

U.S. PATENT DOCUMENTS

| | | | | |
|---|---|---|---|---|
| D728,526 | S | 5/2015 | Zhang | |
| 2004/0252859 | A1 | 12/2004 | Saiki | |
| 2008/0118098 | A1 | 5/2008 | Irby et al. | |
| 2008/0279406 | A1 | 11/2008 | D'Hoogh | |
| 2010/0194578 | A1 | 8/2010 | Zhang | |
| 2012/0063626 | A1* | 3/2012 | Peng | H04R 1/2803 381/345 |
| 2012/0163620 | A1 | 6/2012 | Zhang | |
| 2013/0003984 | A1* | 1/2013 | Belafonte et al. | 381/74 |
| 2014/0093097 | A1 | 4/2014 | Zhang | |

OTHER PUBLICATIONS

DrFaulken, Gibberish is My Native Language, "Powered Portable Speaker Shootout," [online], Dec. 13, 2011, [retrieved on Jul. 15, 2014]. Retrieved from the Internet URL: http://journal.drfaulken.com/powered-portable-speaker-shootout/.

SmarTV Ltd, "TranXformer™," http://www.tranxformer.com (last visited Jun. 2015).

* cited by examiner

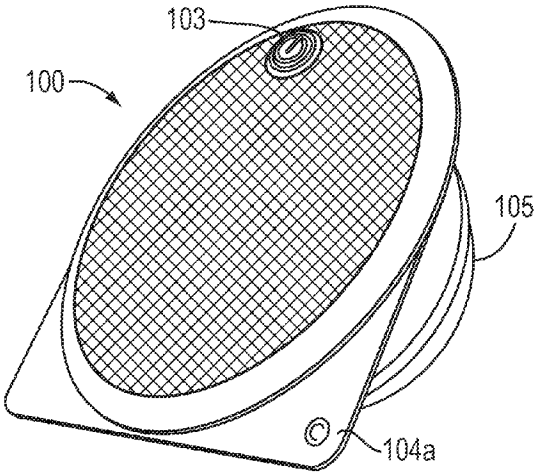
FIG. 1P
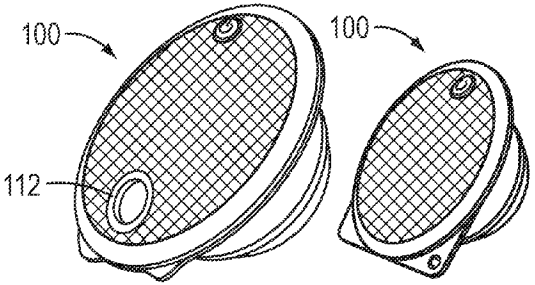
FIG. 1R
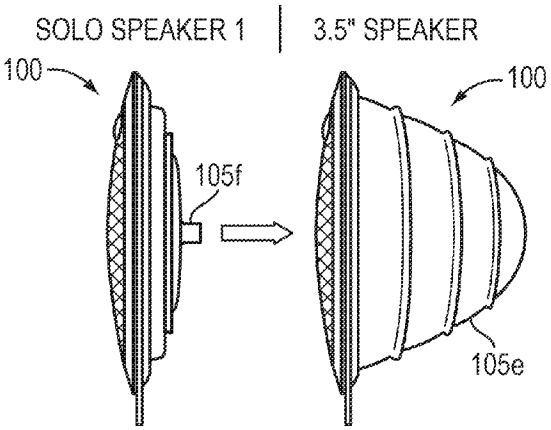
FIG. 1N
FIG. 1O
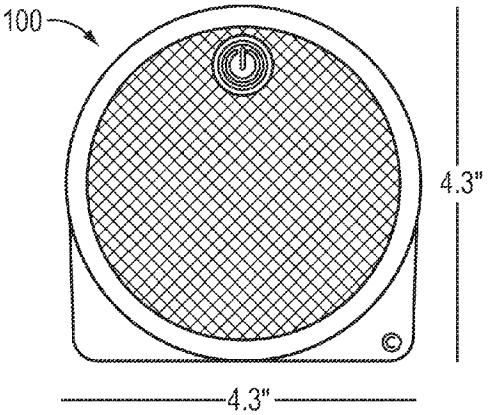
FIG. 1Q

EXPANDABLE SPEAKER PLACED INTO THE CARRIER

SIDE
SLIM FOR PORTABILITY
EXPANDS FOR ENHANCED SOUND

EXPANDABLE SPEAKERS WITH CARRIER | RADIO

SOLO SYSTEM 2 | EXTENDED LIFE BATTERY PACK WITH 3.5" TFT DISPLAY

DUO SYSTEM | EXTENDED LIFE BATTERY PACK WITH DUAL SPEAKERS & MEDIA DECK

FEET UP

DOWN

EXPANDABLE SPEAKER

RELATED APPLICATION

This application claims the benefit of U.S. Provisional Application No. 61/867,350, filed on Aug. 19, 2013. The entire teachings of the above application are incorporated herein by reference.

BACKGROUND OF THE INVENTION

The increased use of technology and portable computers has generated a corresponding increase in the need for portable audio technology. This ever-increasing need for portable audio technology requires corresponding audio devices which are compact, portable, and effective.

A speaker, also known as an audio speaker and/or audio module, is a commonly used audio device. Speakers are used to convert electrical signals received from a sound generator or source (such as computers) into audible or audio signals. In this way, a speaker is an electroacoustic transducer that produces sound in response to an electrical signal input. Speakers include loudspeakers, computer speakers, and other types of speakers.

SUMMARY OF THE INVENTION

Currently, there is a need in the industry for audio modules and/or speakers that are portable, effective, and compatible with portable devices such as smart phones, digital music players, and the like. The apparatus, system, and methods described herein provide a solution to this need. The apparatus, system, and methods described herein provide a user-selectably expandable chamber used in conjunction with an audio module and/or speaker that converts electronic signals to audible sound. The chamber, when in an expanded state, enhances the audio module's and/or speaker's acoustical properties, yet also when in a collapsed state provides portability and a thin profile. The audio module and/or speaker is compatible with current electronics.

The present invention is directed to a speaker and/or audio device. In an embodiment of the present invention, the speaker may include a device that converts electronic signals to audible sound. The speaker may further include a chamber attached to the device. The chamber may be configured (shaped) to control resonance of the sound waves generating the audible sound and thus control acoustic qualities of the audible sound. The chamber may be further structurally configured to selectively expand and collapse.

In an embodiment, the chamber may be constructed of a material that enables the chamber to selectably change profile between expanded and collapsed states. In one embodiment, the material is a flexible material. The flexible material may include at least one of the following: elastomer material, thermo plastic elastomer, rubber, silicon, and formed eva.

In another embodiment, the chamber may be constructed of rigid materials fashioned in a telescopically sliding geometry. In yet another embodiment, the chamber is constructed of part flexible material and part rigid material. The rigid material(s) may include stainless steel. In yet another embodiment, the chamber may be constructed of concentric bands of rigid material that concentrically slide one into the other. In an embodiment, the concentric bands of rigid material may be combined with flexible seams made of flexible material that enable the areas between concentric bands to fold in a fashion that permits the chamber profile to selectably change between expanded and collapsed state.

In an embodiment, expanding the chamber modifies the audible sound by comparison with the audible sound when the chamber is not expanded. In another embodiment, collapsing the chamber modifies the audible sound by comparison with the audible sound when the chamber is not collapsed. In yet another embodiment, the speaker selectably performs at least one of expanding and collapsing based on user selection and communication from a wireless device. In yet another embodiment, the speaker selectably performs the at least one of expanding and collapsing based on user commenced communication from a device wired to the speaker, a user manually manipulating the chamber and the like.

An embodiment of the present invention may be an audio speaker apparatus, system or the like involving or otherwise having a device and a chamber as described above. The device may convert electronic signals to audible sound. The chamber may be attached to the device. The chamber may be geometrically configured (or shaped) to control the acoustic qualities of the audible sound. The chamber may be further structurally configured to perform at least one of expanding and collapsing in profile, in response to user command or selection. In an embodiment, the audio speaker chamber may be constructed of a material that enables the chamber to perform the at least one of expanding and collapsing under user selection or command. In another embodiment, the audio speaker chamber may be constructed of at least one of the following: flexible material and rigid material.

An embodiment of the present invention may include an acoustic system, method or the like for reproducing sound that may include a device and a chamber as described above. The acoustic system may include a device that converts electronic signals to audible sound. The acoustic system may also include a chamber attached to the device. The chamber may be geometrically configured to control the acoustic qualities of the audible sound. The chamber may be further structurally configured to have a user selectably changeable profile at least one of expanded and collapsed positions. The chamber of the acoustic system may be constructed of a material that enables the chamber to selectably change between the at least one of expanded position and collapsed position. The chamber of the acoustic system may be constructed of at least one of the following: flexible material and rigid material.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIGS. 1A-1R are perspective and schematic views of embodiments of the present invention.

FIG. 1A is a schematic front view of a collapsible speaker.

FIG. 1B is a schematic rear view of a collapsible speaker.

FIGS. 1M-1R are schematic views of another embodiment of the collapsible speaker that includes a built in rechargeable battery.

FIGS. 2A and 2B illustrate respectively, a collapsed profile and an expanded profile of a speaker constructed of flexible material.

FIGS. 2C and 2D illustrate respectively collapsed and expanded profiles of a speaker constructed of rigid material.

FIGS. 2E and 2F illustrate respectively collapsed and expanded profiles of a speaker constructed of flexible and rigid materials.

FIG. 3A is a partially exploded view of a carrier with multiple speakers embodying the present invention.

FIGS. 3S-3W are schematic views of embodiments of the double-speaker carrier of FIG. 3K.

FIG. 5A is a perspective front view of a speaker embodiment with retractable feet (stand).

FIG. 5B is a schematic rear view of the speaker embodiment of FIG. 5A with the retractable feet (stand) in an extended position.

FIG. 5C is a schematic rear view of the speaker embodiment of FIG. 5A with the retractable feet (stand) in a retracted position.

DETAILED DESCRIPTION OF THE INVENTION

A description of example embodiments of the invention follows.

The present invention is directed to a speaker with a design configuration that enables a user to expand the speaker (in physical size and/or shape) to enhance the speaker's acoustical properties and to collapse the speaker afterward for portability, storage and to provide a thin profile. The use of flexible material, such as elastomer, thermo plastic elastomer, rubber, silicon or formed eva in the construction of the speaker chamber allows the user to collapse or expand the rear (i.e. chamber) of the speaker. Various non-elastic materials, such as sheets of stainless steel, may be used alone or combined with the flexible material to expand and collapse the rear of the speaker and vary the acoustical properties of the speaker chamber as further shown in the attached drawings.

The expansion may be user-selectable. The expansion may be caused/produced manually by a user, or by electro-mechanical means and methods activated by button-type actuators and/or a wireless connection, or the like. The drawings (FIGS. 1A-5C) are illustrative of various embodiments, features and applications.

Figures 1A, 1B:
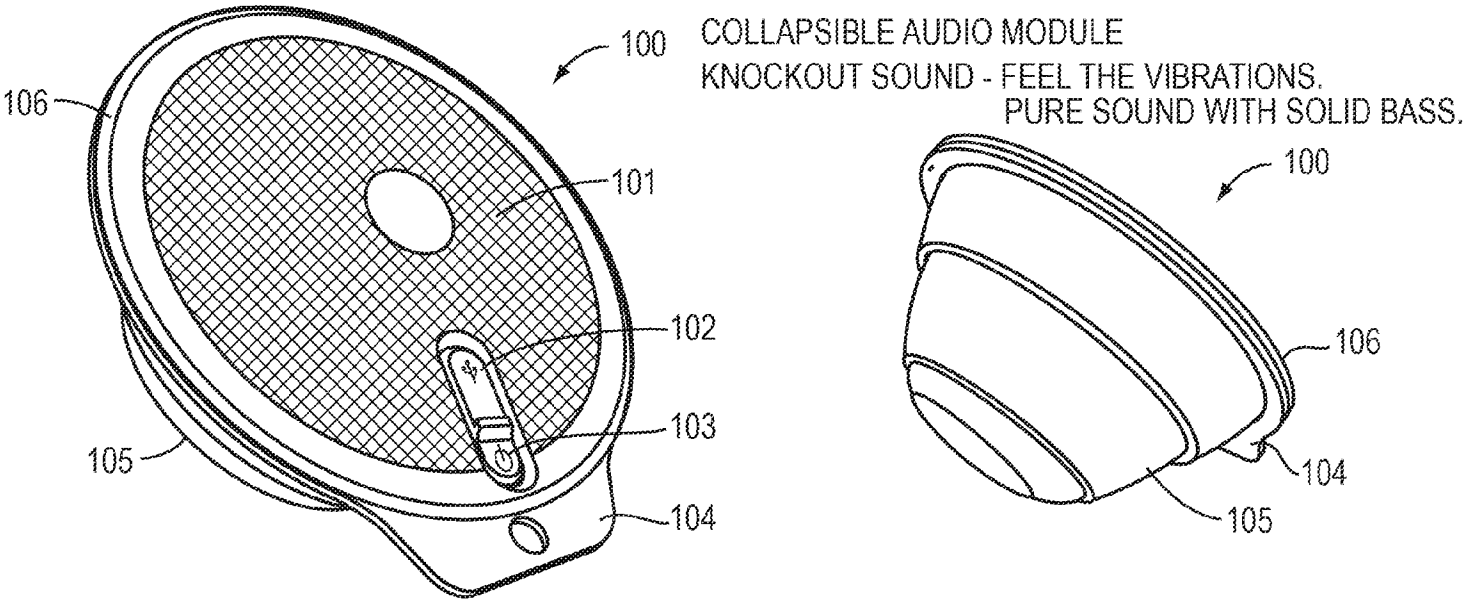
Figure 1D:
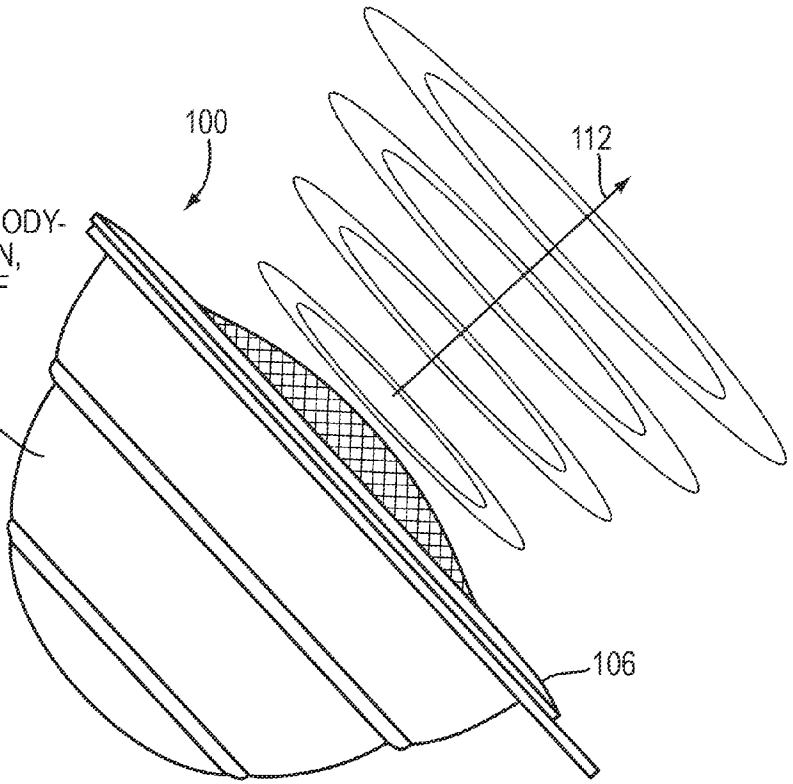
FIG. 1D is a schematic side view of a collapsible speaker with an expanded body.
Figure 1C:
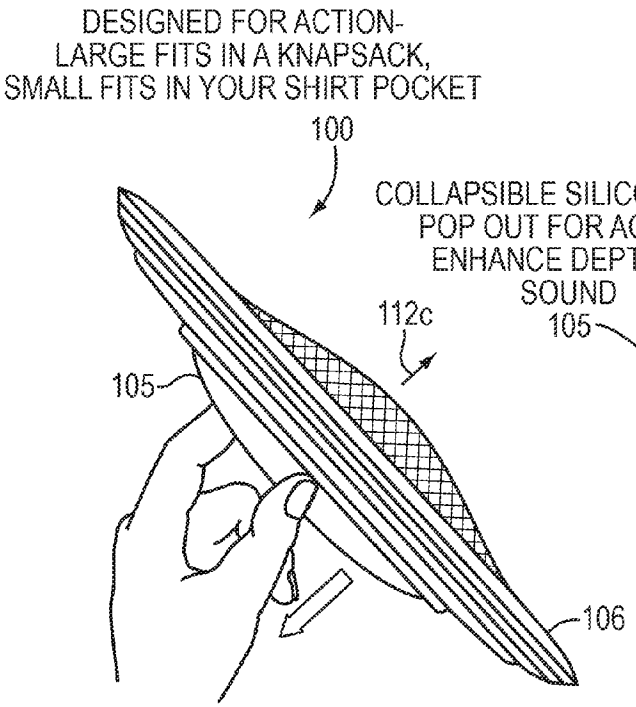
FIG. 1C is a schematic side view of a collapsible speaker with a collapsed body.
Figures 1E, 1F:
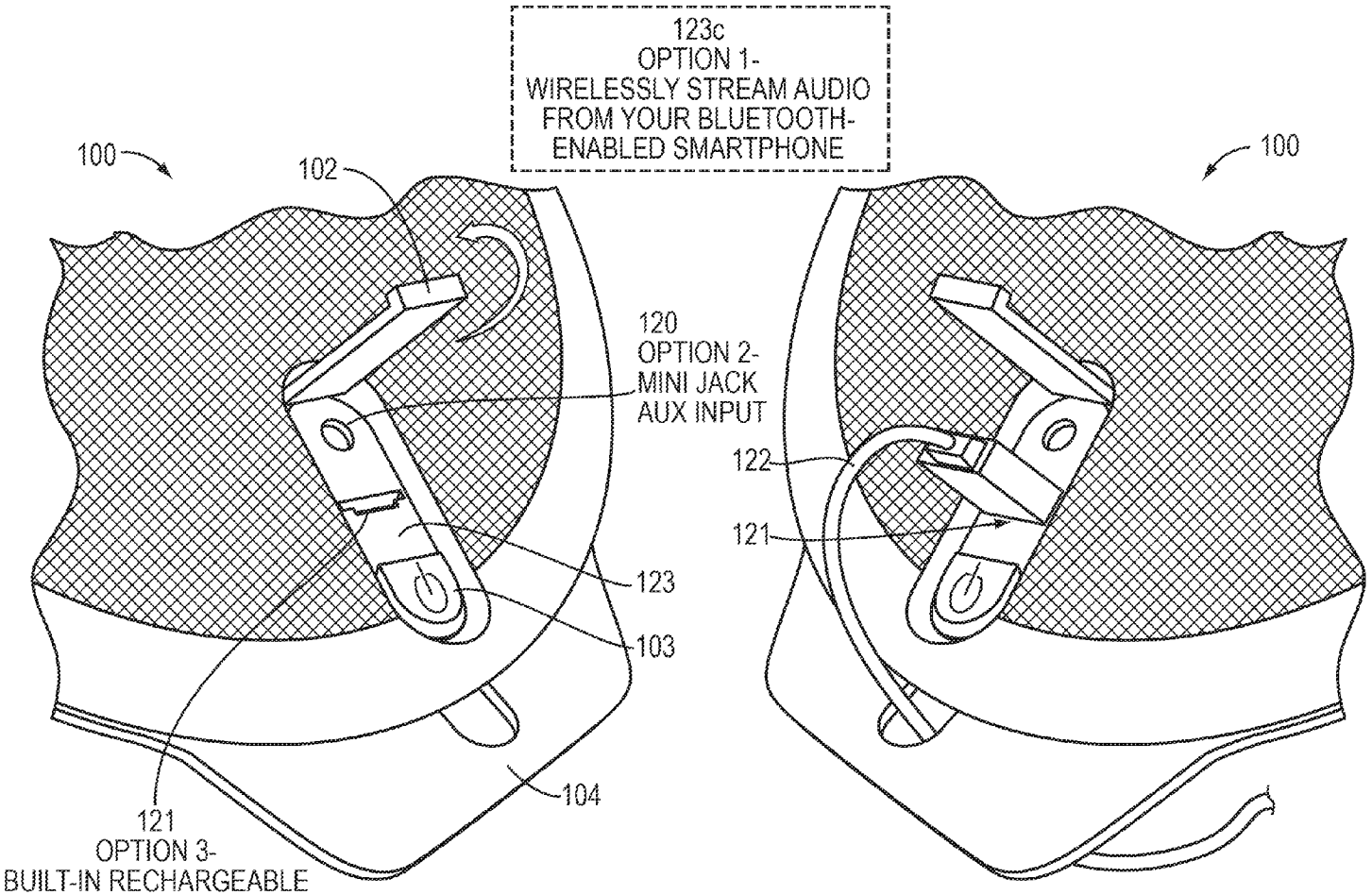
FIG. 1E is a schematic front view of a collapsible speaker system that includes a miniature auxiliary input jack and a USB port.
FIG. 1F is a schematic front view of a collapsible speaker system that includes a miniature auxiliary input jack and a USB charging cable.
Figure 1I:
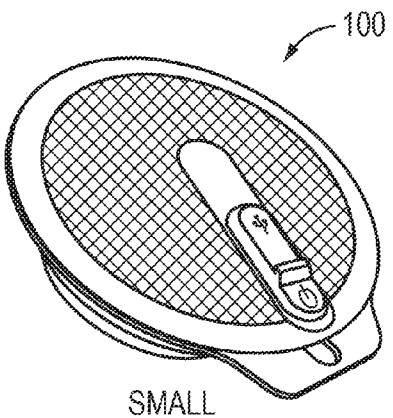
FIGS. 1G-1I are schematic views of embodiments of the collapsible speaker in a variety of overall sizes, for example large, medium, and small respectively.
Figure 1H:
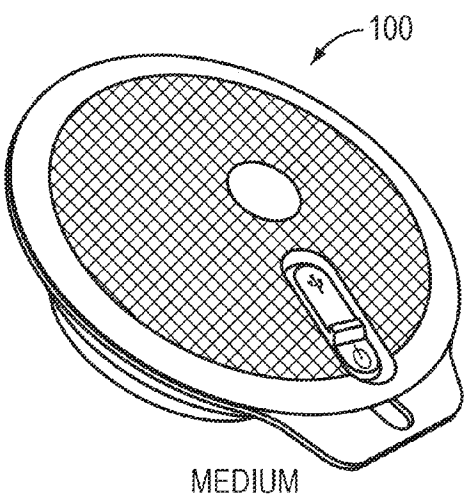
Figure 1G:
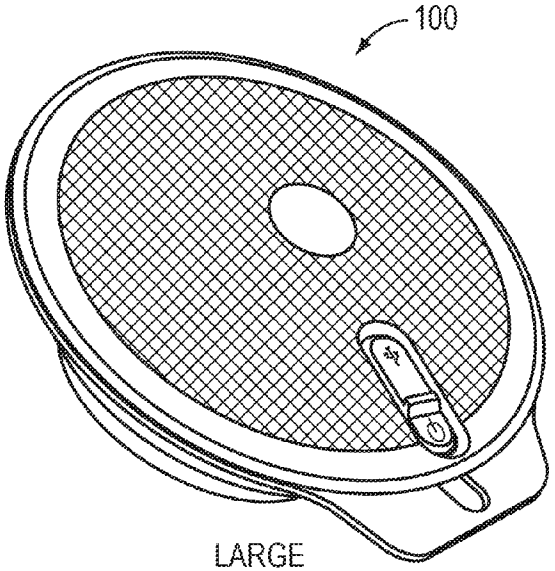
Figure 1L:
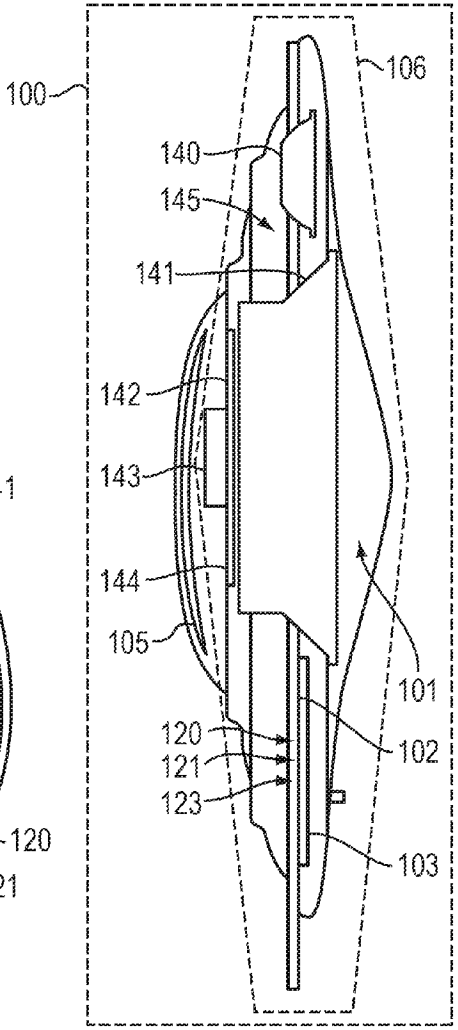
FIGS. 1J-1L are schematic views of an embodiment of the collapsible speaker that includes a built in rechargeable battery.
Figure 1J:
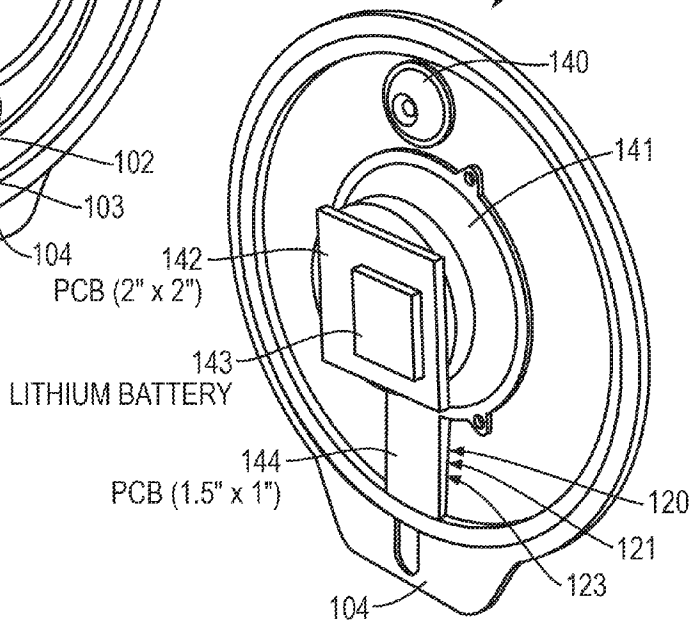
Figure 1K:
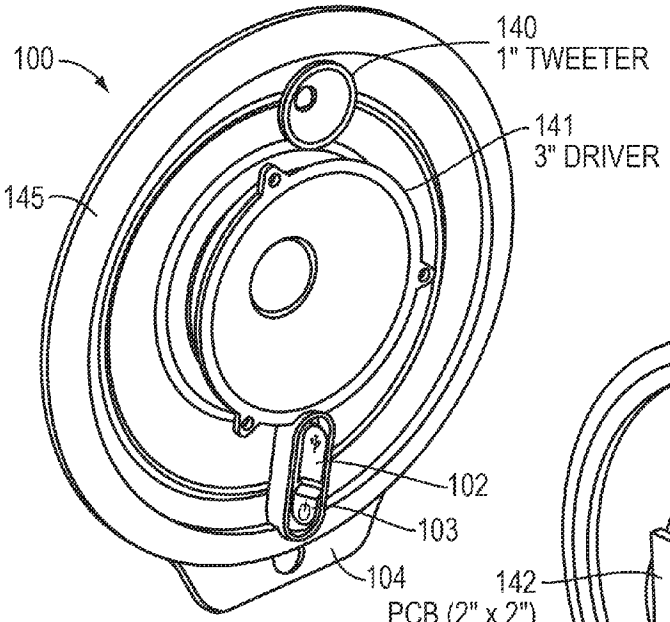

FIGS. 1A-1L are perspective and schematic views of a collapsible speaker and/or audio module embodying the present invention. In particular, FIGS. 1A-1D illustrate a collapsible silicon body, in the example embodiment. FIGS. 1E-1F illustrate a miniature auxiliary input jack in the example embodiment. FIGS. 1J-1L illustrate the embodiment having a built in rechargeable battery that uses a USB charging cable shown in FIGS. 1E-1F. FIGS. 1G-1I illustrate embodiments of a variety of overall sizes.

Turning to FIGS. 1A-1B, illustrated is a collapsible speaker and/or audio module 100 (also referred to as a "speaker") of the present invention. As shown in FIG. 1A, a speaker 100 may include a cover 101 (comprising a metal mesh, plastic mesh, or other material), a latch and/or adjustable latch 102, a power switch 103, a stand 104, a body 105 that is selectably expandable and/or collapsible, and an electronic device 106 for the speaker's operation. FIG. 1B illustrates a schematic rear view of the speaker 100 of FIG. 1A.

As illustrated in FIGS. 1C-1D, a speaker 100 may include a silicon body and/or chamber 105 that may be selectably collapsible and expandable. FIG. 1C illustrates a speaker 100 with its body 105 in collapsed form (and/or collapsed profile). FIG. 1D illustrates the speaker 100 of FIG. 1C but with its body 105 in expanded form (and/or expanded profile). As illustrated in FIGS. 1C-1D, the speaker 100 may generate audible sound (and/or audio output signals) when the speaker body 105 is collapsed or expanded (see audible sound 112*c*, 112, respectively). Preferably, audible sound (112*c*, 112) generated by the speaker 100 is improved and/or modified by using the body 105 in its expanded form (and/or expanded profile) of FIG. 1D by comparison with the collapsed form (and/or collapsed profile) of body 105 as shown in FIG. 1C.

Also illustrated in FIGS. 1C-1D, speaker 100 comprises a device 106 that converts electronic signals to audible sound 112*c*, 112. The device 106 is attached to the body or chamber 105. The body/chamber 105 is configured to control the acoustical qualities of audible sound 112*c*, 112. The speaker 100 of FIGS. 1C-1D may also be considered an audio speaker apparatus and/or an acoustic system.

Restated, expanding the body and/or chamber 105 (as in FIG. 1D) may produce modified audible sound 112 by comparison with the audible sound 112*c* that the speaker 100 produces when the chamber 105 is not expanded (as in FIG. 1C). Similarly, as illustrated in FIG. 1C, collapsing the chamber 105 may produce modified audible sound 112*c* by comparison with the audible sound 112 that the speaker 100 produces when the chamber 105 is not collapsed (as in FIG. 1D).

FIGS. 1E-1F illustrate additional features or elements of speaker 100. As illustrated in FIGS. 1E-1F, the speaker 100 may include a power button and/or switch 103 to enable and/or disable power to the speaker 100. The power button 103 may also provide an indication of power being on or off through an electronic display on the power button 103. The electronic display on the power button 103 may provide a color indication, or lack thereof, to provide an indication of power or lack of power to the user. For non-limiting example, the display may be a green light for "power on" and no (dimmed) light for "power off," although other combinations of colors may be employed in the display.

As illustrated in FIGS. 1E-1F, the latch 102 may be moved between open and closed positions, preferably by a user, and alternatively through a wired or wireless control to the speaker 100. As illustrated in FIG. 1E, under the latch 102, the speaker 100 may have a mini jack auxiliary input port 120. A first audio input port 120 (a mini jack auxiliary port) may be configured to receive the following, but is not so limited: a mini jack/plug, audio jack, stereo jack/plug, mini-stereo, microphone jack, or other type of jack/plug. The mini jack auxiliary input port 120 enables a user to provide an electronic audio input to the speaker 100 through an audio jack plug, connector or other means known in the art. A user is also enabled to provide electronic audio input to the speaker 100 through a second audio input port 121 (a USB and/or Mini-USB port) which also may function as a power input to recharge the battery of the speaker 100.

As illustrated in FIG. 1F, the speaker 100 enables a user to provide electronic audio input to the speaker 100 through the second audio input port 121 (a Mini-USB port) by using a Mini-USB cable 122 or other means. Alternatively, the second audio input port 121 may be: (i) a Micro-USB port in which case the user uses a Micro-USB cable, (ii) a standard USB port in which case the user uses a Standard-USB cable, or (iii) any other standard port and corresponding cable known in the art.

Additionally, as illustrated in FIG. 1E, a user may provide wireless electronic audio input 123*c* to the speaker 100. In one embodiment, the speaker 100 enables wireless input 123*c* from an wireless audio stream by a BLUETOOTH-enabled smartphone for non-limiting example. The speaker 100 enables the wireless input 123*c* through a wireless port 123 within the speaker 100. The wireless port 123 may receive the wireless input signals 123*c*, and the wireless port 123 is capable of wireless communication with an external wireless device.

As illustrated in FIGS. 1G-1I, the speaker 100 may be provided in a variety of sizes including a small pocket-sized version in FIG. 1I, a knapsack-sized version in FIG. 1H, or a larger version in FIG. 1G. The speaker 100 size is not limited, and larger or smaller speakers 100 may be used. In the preferred embodiment, the speaker 100 will be a size which is considered portable by a user.

FIGS. 1J-1L illustrate differing views of speaker 100 and also illustrate components that may be included in a speaker 100. In other words, FIGS. 1J-1L illustrate schematic views of the collapsible speaker 100 that includes a built in rechargeable battery 143. FIG. 1J illustrates a schematic rear view of the speaker 100 with built-in rechargeable battery 143. FIG. 1K illustrates a schematic front view of the speaker 100 of FIG. 1J. FIG. 1L illustrates a schematic side view of the speaker 100 of FIG. 1J.

The speaker 100 as shown in FIGS. 1J-1L may include electronic components as needed for operation as determined by one skilled in the art. For non-limiting example, FIGS. 1J-1L illustrate a speaker 100. The speaker may include a cover 101, a device 106, and a body and/or chamber 105. The speaker device 106 may include a solid housing 145 (including, but not limited to, a chassis, frame, or basket) used to hold the components in place and provide support to the speaker 100 and its components. The speaker components may include a stand 104, one or more drivers 141 for transmitting a broad range of audio frequencies, one or more tweeters 140 for transmitting high audio frequencies. The tweeters 140 may also provide what is known in the art as "true stereo." The speaker components may also include one or more printed circuit boards (PCBs) 142, 144, to enable conversion of the electrical audio input (received by at least one of: a first wired input port 120, a second wired input port 121, and a first wireless input port 123) to audible sound output. The speaker components may also include one or more batteries 143 (lithium batteries, or other types of batteries) used to provide a power source to the speaker 100, a power button 103, and a movable latch 102 with audio input ports underneath it. The latch 102 may be lifted (placed in an open position) by a user to provide access to a first audio input port 120 and a second audio input port 121 to the speaker. In addition, a third input port (a wireless input port 123) is available as illustrated in FIG. 1J-1L.

One or more of the audio input ports (a first wired input port 120, a second wired input port 121, and a first wireless input port 123) may be used to receive electrical signals that the one or more PCBs 142, 144 convert to audible sound that is projected through the one or more tweeters 140 and/or the one or more drivers 141. A battery power source 143 and/or an input power source (such as second audio input port 121) may be used to provide power to the other electronic components of the speaker 100, including but not limited to components 103, 120, 121, 123, 140, 141, 142, 143, 144, in order to enable their function. Optionally, the speaker 100 may include additional speaker functions or other components as known in the art to enable speaker functions.

FIGS. 1M-1R are schematic views of another embodiment of the collapsible speaker that includes a built in rechargeable battery.

Figure 1M:
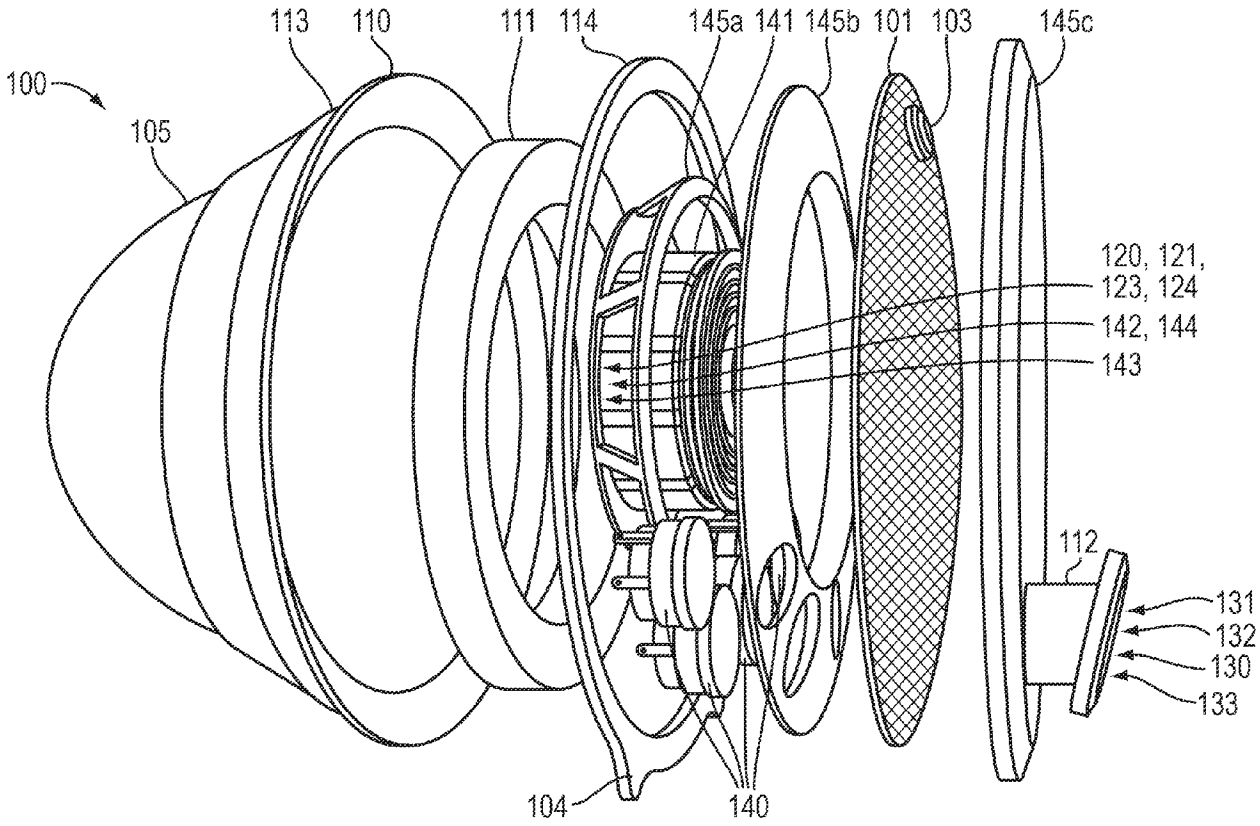

As illustrated in FIG. 1M, a speaker 100 may include a chamber 105 that connects to a ring 110 which includes a rear audio input port 113 which provides an input to the speaker electronics and/or PCBs 142, 144. The speaker ring 110 may connect to a speaker rear base and/or port 111 which connects to a gasket 114 that may include feet 104 for support. The speaker 100 also may include one or more drivers 141 and one or more tweeters 140 (four tweeters 140 are shown in FIG. 1M). Speaker electronics may include one or more printed circuit boards (PCBs) 142, 144, and one or more batteries 143. The electronics of the speaker 100 may also include a wireless input 123 for receiving smart phone wireless input such as BLUETOOTH and/or wireless internet input such as WIFI, and a wired input port 120, mini-USB input 121, and/or USB input 124. The speaker 100 may include a wired mesh cover 101 with an attached power button 103 that connects to the speaker electronics. The speaker 100 may also include a front audio port 112 which connects through to the rear port 111 in order to provide enhanced sound (such as bass).

The front audio port 112 may include control buttons for enabling and/or disabling features, by a user pressing each given control button 130, 131, 132, 133 one or more times for its respective feature. For non-limiting example, the speaker port 112 may include a wireless internet (e.g., WIFI) button 131 to enable and/or disable a wireless internet input to the speaker 100 based upon a user pressing the button 131 one or more times. The speaker port 112 may also include a wireless smart phone button (e.g. BLUETOOTH) 132 to enable and/or disable a wireless smart phone input to the speaker 100 based upon a user pressing the button 132 one or more times. The speaker port 112 may also include a phone sync and/or call indicator 133 that enables the speaker 100 to function as a speaker phone, while the speaker 100 receives wireless input through a smart phone. The speaker port 112 may also include volume controls 130 to increase and/or decrease the volume of the speaker 100. The speaker 100 may include one or more frame components 145*a*, 145*b*, 145*c* that may be used to secure the speaker components 101, 103, 104, 105, 110, 111, 112, 113, 114, 120, 121, 123, 130, 131, 132, 133, 140, 141, 142, 143, and 144.

FIGS. 1N-1R are schematic views of embodiments of the speaker 100 of FIG. 1M. Based on a user-selectable command (received either wirelessly or in a wired manner), the speaker 100 may contract its chamber 105*f* or expand is chamber 105*e* as illustrated in FIG. 1N and FIG. 1O, respectively. As illustrated in FIG. 1Q, the speaker 100 may be of dimensions 4.3 inches by 4.3 inches, although its dimensions are not so limited. As illustrated in FIG. 1P, the speaker 100 may include a power button 103, a chamber 105, and a flat front stand 104*a* that provides the speaker 100 with support while the speaker 100 rests against a surface. As illustrated in FIG. 1R, a speaker 100 may be constructed in a variety of sizes and a speaker 100 may or may not include a port 112.

FIGS. 2A-2F are schematic view illustrations of three methods of construction of the speaker and different material types employed in embodiments for expansion and contraction. As illustrated in FIGS. 2A-2F, the speaker 100 may be constructed of flexible material 107 (see FIGS. 2A and 2B), constructed of rigid material 108 (see FIGS. 2C and 2D), or constructed of a combination of flexible material 107 and rigid material 108 (see FIGS. 2E and 2F). The flexible material 107 may include at least one of the following: elastomer material, thermo plastic elastomer, rubber, silicon, and formed eva.

Figure 2A:
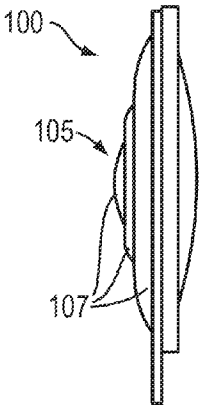
FIGS. 2A-2F are schematic view illustrations of three methods of construction of the speaker and different material types employed in embodiments.
Figure 2B:
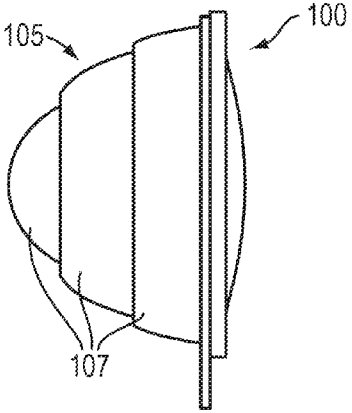
Figure 2C:
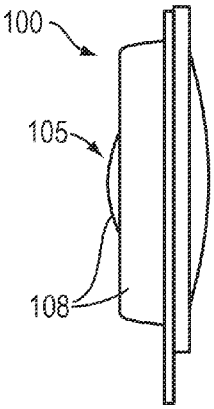
Figure 2D:
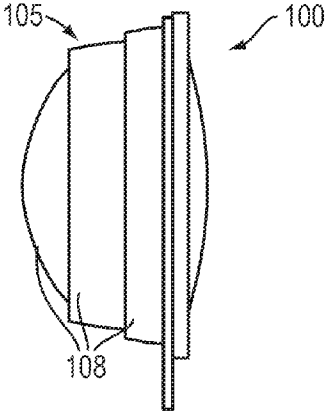

As illustrated in FIGS. 2C and 2D, the chamber 105 may be constructed of rigid materials 108 (including, but not limited to, stainless steel or metal bands) that telescopically slide one into the other. For non-limiting example, the chamber 105 may be constructed of concentric bands of rigid materials 108 that concentrically slide one into the other.

Figure 2E:
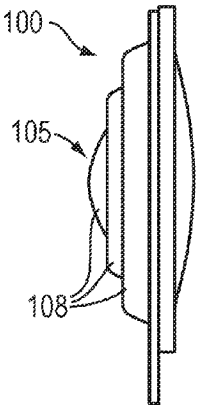
Figure 2F:
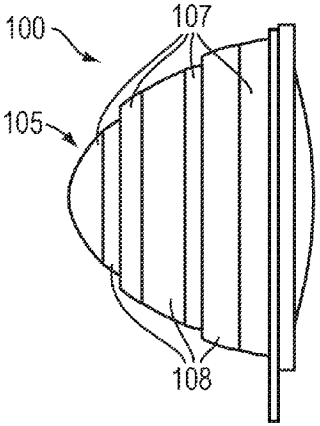

As illustrated in FIGS. 2E and 2F, the chamber 105 of the speaker 100 may be constructed of a combination of part flexible material 107 and part rigid material 108. In one embodiment, the concentric bands of rigid materials 108 may be combined with flexible seams made of flexible material 107 that enable the areas between concentric bands to fold in a fashion that permits the chamber 105 to be expanded (as in FIG. 2F) at the selection of the user and likewise collapsed (as in FIG. 2E) at the selection of the user.

As further illustrated in FIGS. 2A-2F, the speaker 100 chamber 105 may be constructed of a material (107, 108, or a combination of 107 and 108) that enables the chamber 105 to expand or collapse under user control. FIGS. 2A, 2C, and 2E each illustrate a speaker 100 with the chamber/body 105 in a closed (collapsed) position. FIGS. 2B, 2D, and 2F illustrate the respective speaker 100 (a given corresponding speaker 100 of FIG. 2A, FIG. 2C, and FIG. 2E, respectively) with the chamber/body 105 in an open (expanded) position. In other words, the speaker 100 shown in FIG. 2B is the expanded version of the speaker 100 in FIG. 2A. The speaker 100 shown in FIG. 2D is the expanded version of the speaker 100 in FIG. 2C, and the speaker 100 in FIG. 2F is the expanded version of the speaker 100 in FIG. 2E. In the expanded position, speaker body 105 provides an enclosed volume such as a cone shape, funnel shape, conic, conical and/or conoid that enhances resonance of sound waves and acoustic qualities and thus efficiency of the speaker.

Figure 3A:
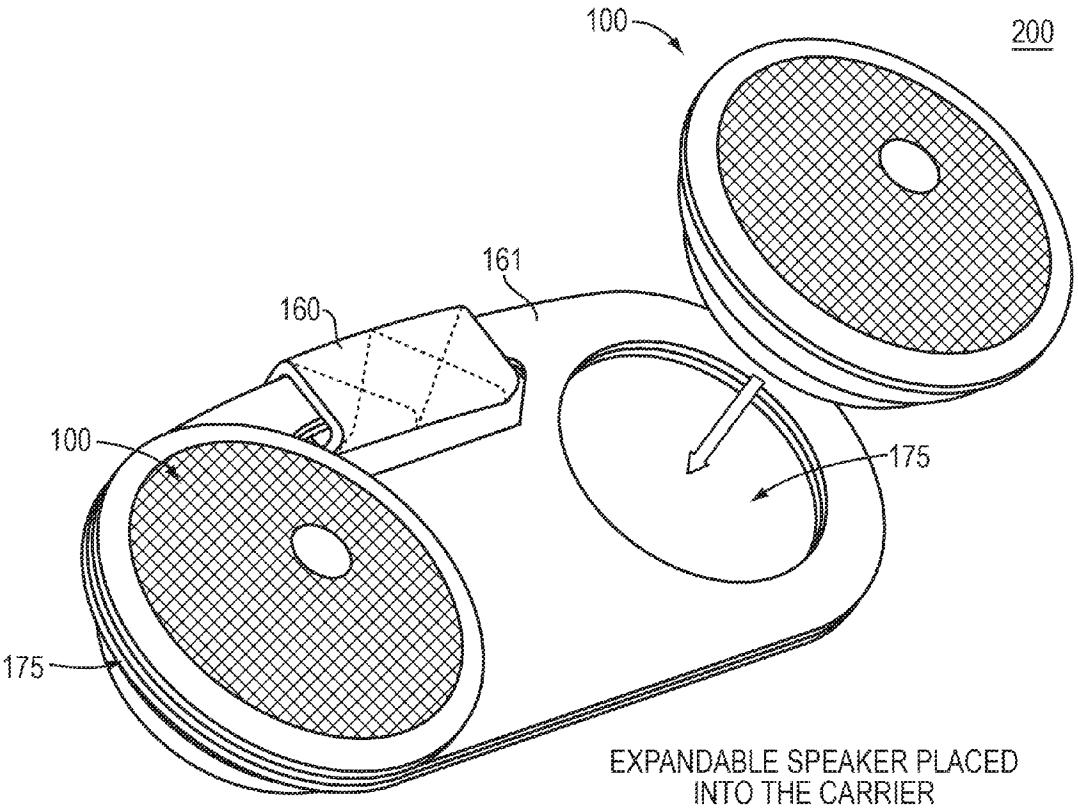
FIGS. 3A-3W are schematic views of non-limiting example carriers and housings (with or without a radio) of embodiments.
Figure 3C:
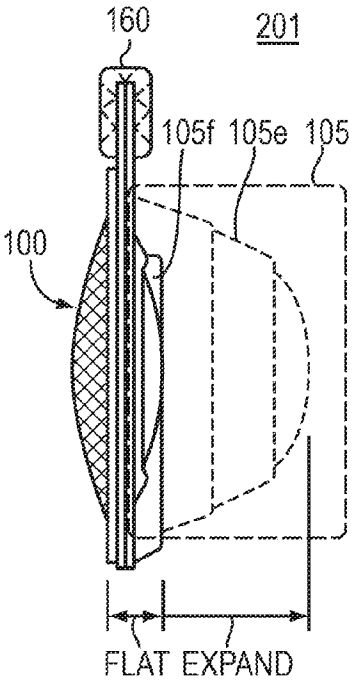
FIG. 3C is a schematic side view of the carrier of FIG. 3B.
Figure 3B:
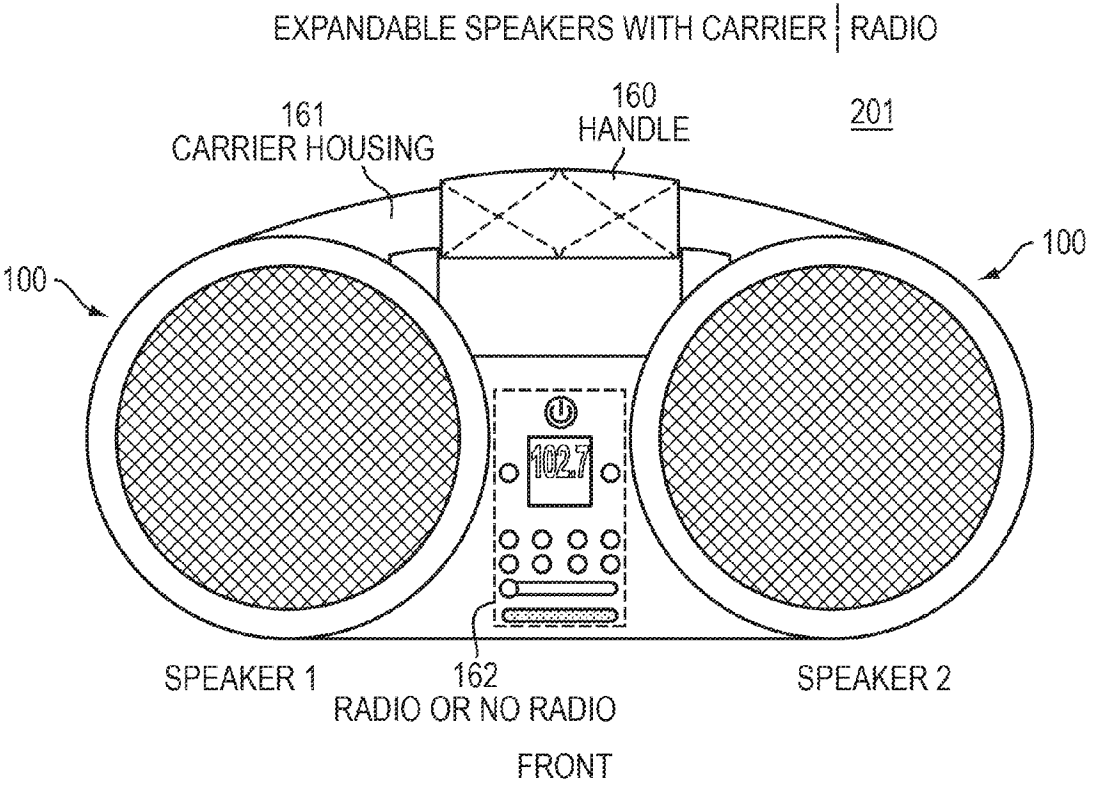
FIG. 3B is a front schematic view of a carrier with multiple speakers of the present invention and an optional radio.
Figure 3D:
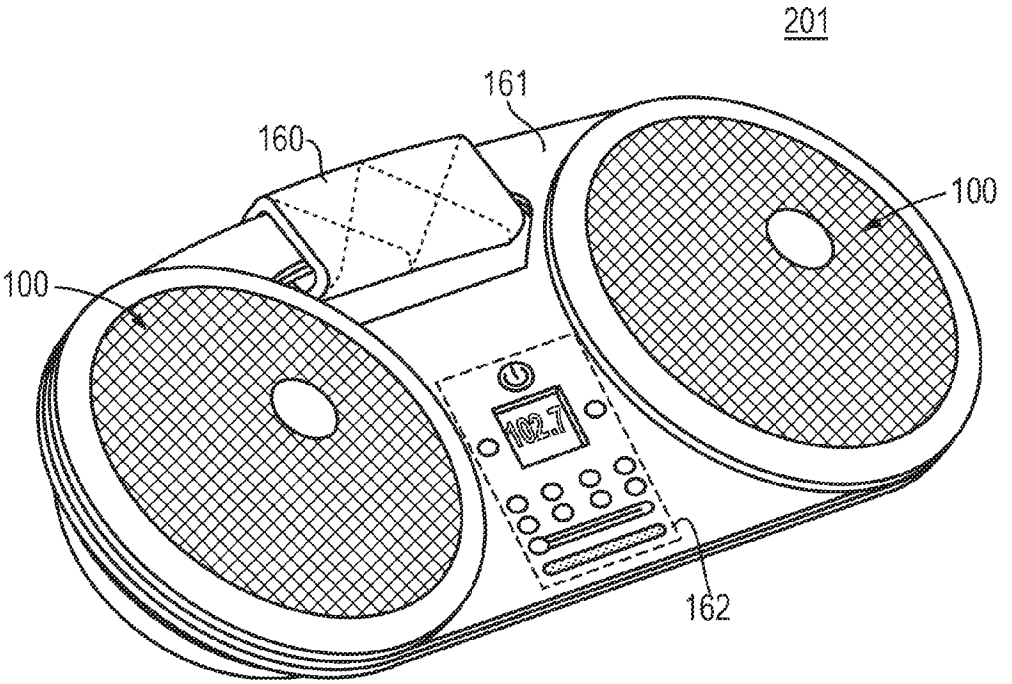
FIG. 3D is a perspective view of the carrier of FIG. 3B, the speakers in an expanded state.

FIGS. 3A-3H are schematic views of non-limiting example carriers and housings (with or without a radio) of embodiments. FIG. 3A is a schematic view of a carrier 200 that holds multiple speakers 100 in a removably secure manner. As illustrated in FIG. 3A, carrier 200 slots and/or openings 175 are sized and shaped (dimensioned) to accommodate the geometry of the speaker 100. As illustrated in FIG. 3A, the one or more speakers 100 are ported in, yet removable from slots or openings in the carrier 200 and the carrier has an otherwise solid body 161 and a handle 160 for the user. FIGS. 3B and 3D are schematic views of another carrier 201 which includes an optional radio 162 and also has a handle 160, body 161, and multiple speakers 100. The carrier 201 body 161 as described above for carrier 200 has slots or openings where speakers 100 are seated. FIG. 3C is a side view of the carrier 201 of FIGS. 3B and 3D. As illustrated in FIG. 3C, the geometries (e.g., shape, dimensions, configuration, hole battery openings) of the carrier 201 and carrier body 161 allow the respective chamber 105 of speaker 100 to be expanded 105*e*, or a collapsed (flat) 105*f* as the user desires (operatively sets). That is, the user can expand/collapse the speaker chamber (body) 105 while the speaker 100 is seated in the carrier 201 slot as well as expand/collapse the speaker chamber 105 before seating (or returning) the speaker 100 to the carrier 201 slot.

Figure 3F:
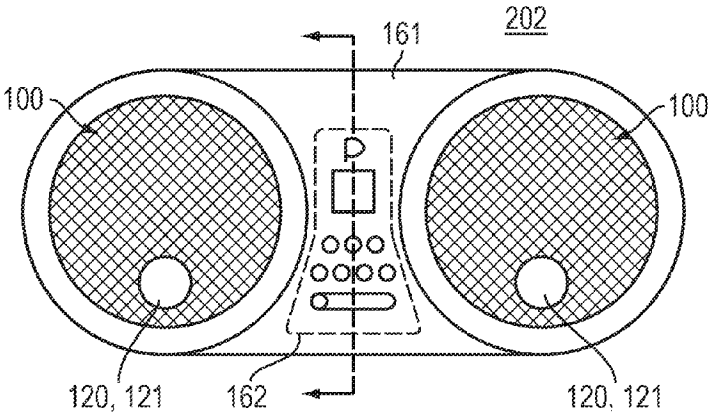
FIG. 3F is a schematic front view of the carrier of FIG. 3E.
Figure 3G:
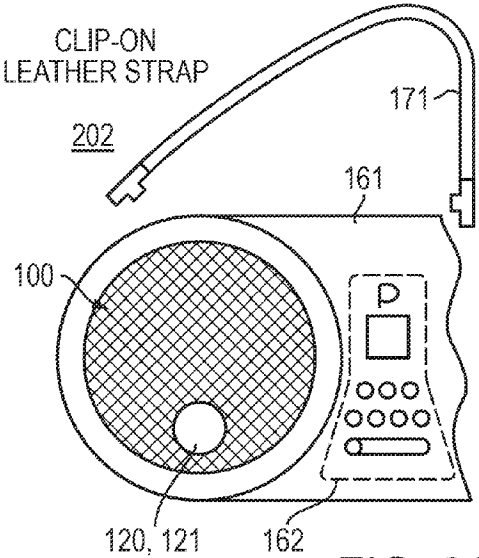
FIG. 3G is a partial schematic view of the carrier of FIG. 3F, further including an optional clip-on strap.
Figure 3H:
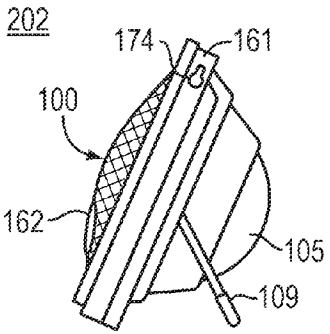
FIG. 3H is a schematic side view of the carrier of FIG. 3F, further including an optional stand.
Figure 3E:
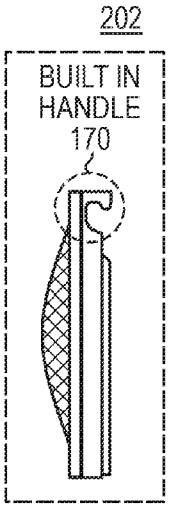
FIG. 3E is a schematic side view of a carrier with a built in handle and carrying multiple speakers and an optional radio.

FIG. 3E is a schematic side view of another carrier 202 which includes a built in handle 170 for a user to carry the carrier 202. FIG. 3F is a schematic front view of the carrier 202 of FIG. 3E, illustrating each speaker 100 with its corresponding first input port 120 and second input port 121, an optional radio 162, and the carrier body 161. The carrier body 161 has slots or seated areas accommodating speakers 100 as described above for carriers 200 and 201. FIG. 3G is a partial schematic view of the carrier 202 of FIG. 3F, further including an optional clip-on strap 171. The ends of the strap 171 attach to cooperating areas 174 on the sides of carrier 202 as shown in FIG. 3H. FIG. 3H is a schematic side view of the carrier 202 of FIG. 3G, further including an optional stand 109 to maintain stability for the carrier and illustrating the rear body 105 of speaker 100 in expanded state (position). The optional stand 109 maintains stability when the carrier 202 sits on a surface.

Figures 3I, 3J, 3K:
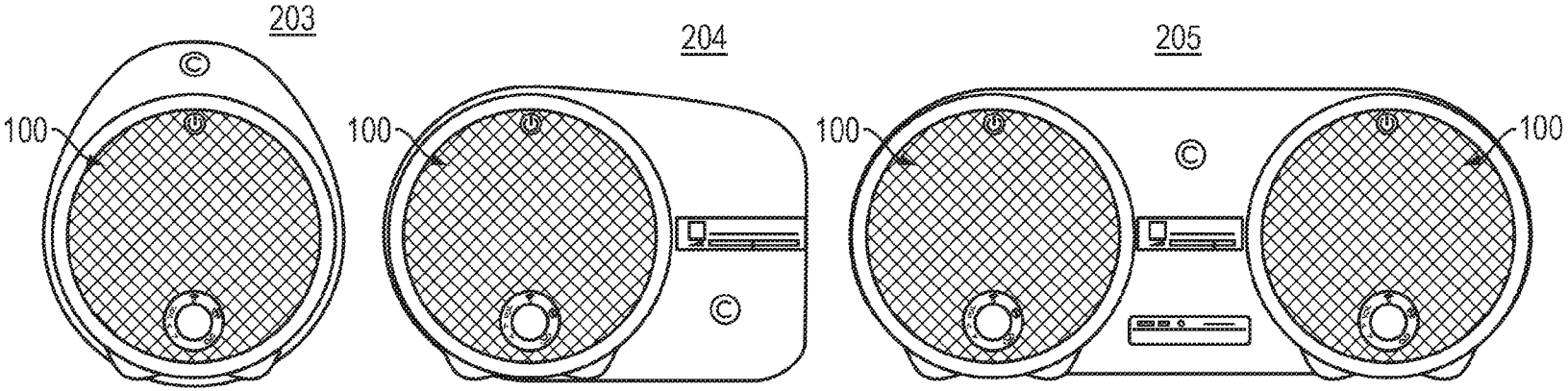
FIG. 3I-3K are schematic views of embodiments of speaker carriers, including a single-speaker carrier, a single-speaker carrier with a radio display, and a double-speaker carrier with a radio display and media deck, respectively.

FIG. 3I-3K are schematic views of embodiments including collapsible speakers 100 in a variety of carrier types, for example a single-speaker carrier 203 (FIG. 3I), a single-speaker carrier with a radio display 204 (FIG. 3J), and a double-speaker carrier 205 (FIG. 3K) with a radio display and media deck, respectively.

Figure 3M:
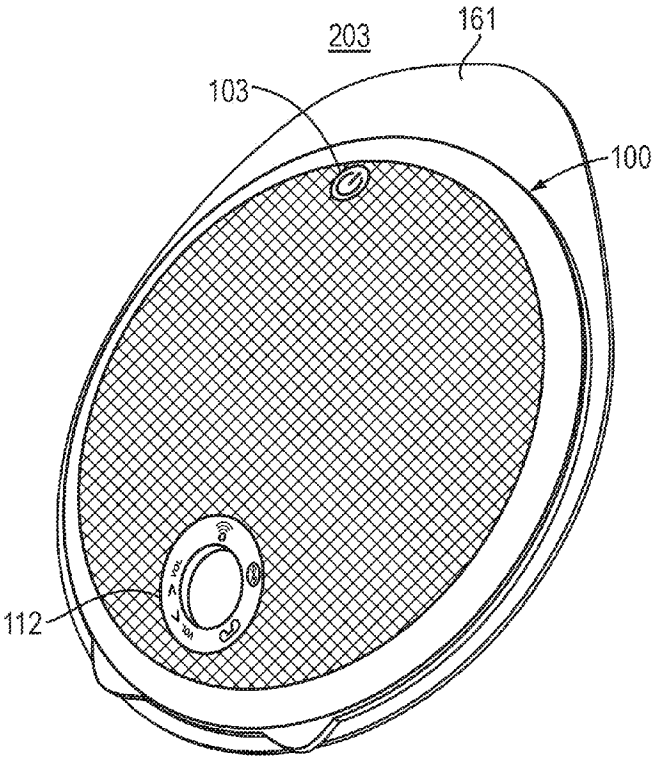
FIG. 3M is a schematic front view of the single-speaker carrier of FIG. 3I.
Figure 3L:
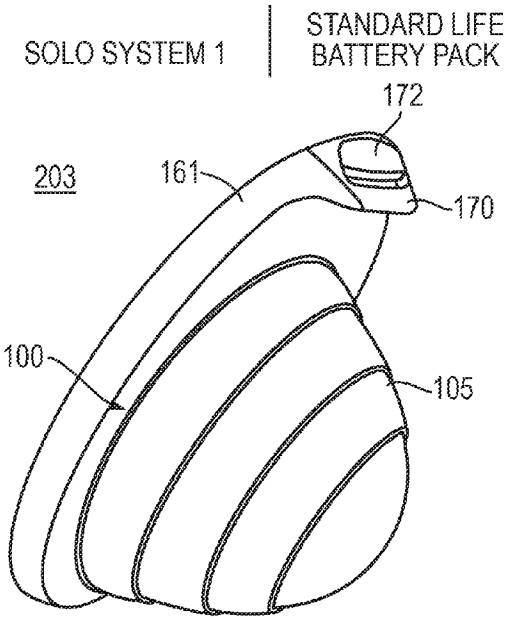
FIG. 3L is a schematic rear view of the single-speaker carrier of FIG. 3I.
Figure 3O:
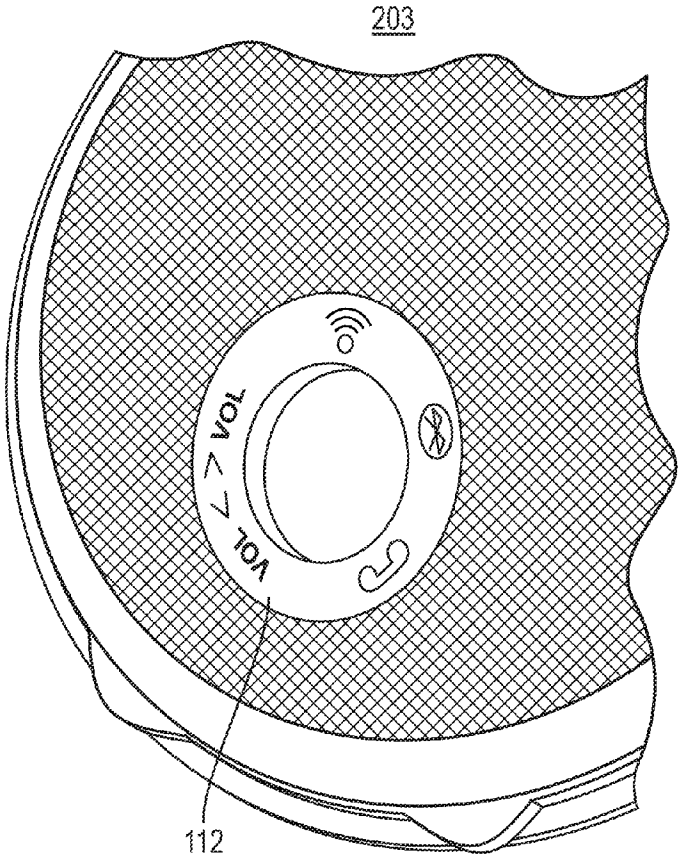
FIG. 3O is a schematic front view of the single-speaker carrier of FIG. 3I.
Figure 3N:
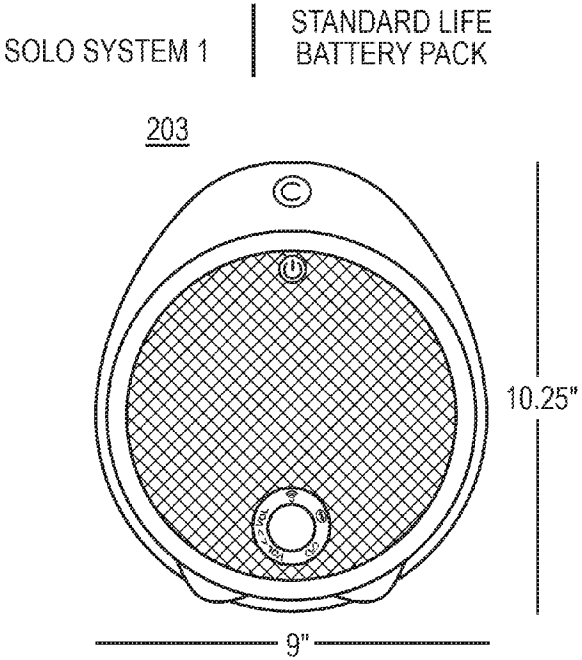
FIG. 3N is a schematic front view of the single-speaker carrier of FIG. 3I.

FIG. 3L is a schematic rear view of the single-speaker carrier 203 of FIG. 3I. FIG. 3L illustrates a battery door and/or hatch 172 for adding or removing one or more batteries, a handle 170 for a user to carry the carrier 203, a carrier housing 161, and a rear view of a chamber 105 of the speaker 100. FIG. 3M is a schematic front view of the single-speaker carrier 203 of FIG. 3I, illustrating a front port 112 and power button 103. FIG. 3N illustrates one embodiment of the carrier 203 with dimensions 10.25 inches by 9 inches, although the carrier 203 is not so limited. FIG. 3O illustrates a closer view of the port 112 (with button 130, 131, 132, 133 detail) of the carrier 203 of FIG. 3I.

Figure 3Q:
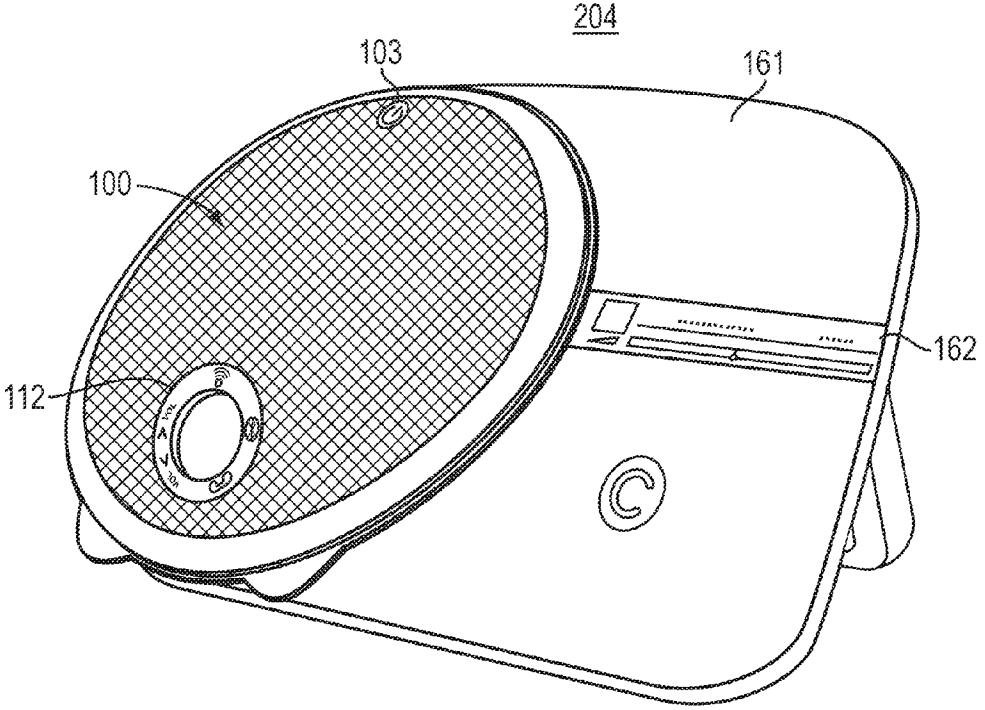
FIG. 3Q is a schematic view of the single-speaker carrier of FIG. 3J.
Figure 3P:
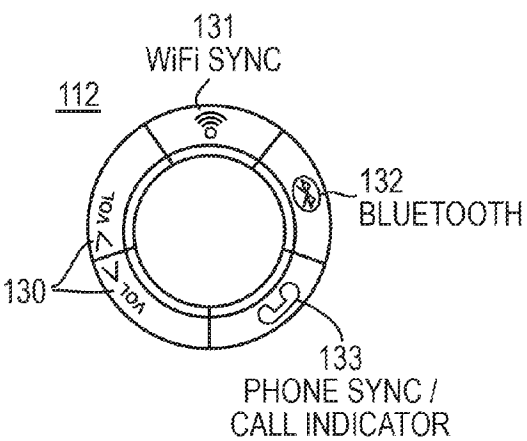
FIG. 3P is a schematic view of a port that may be included in the speaker carriers of FIGS. 3I-3K.
Figure 3R:
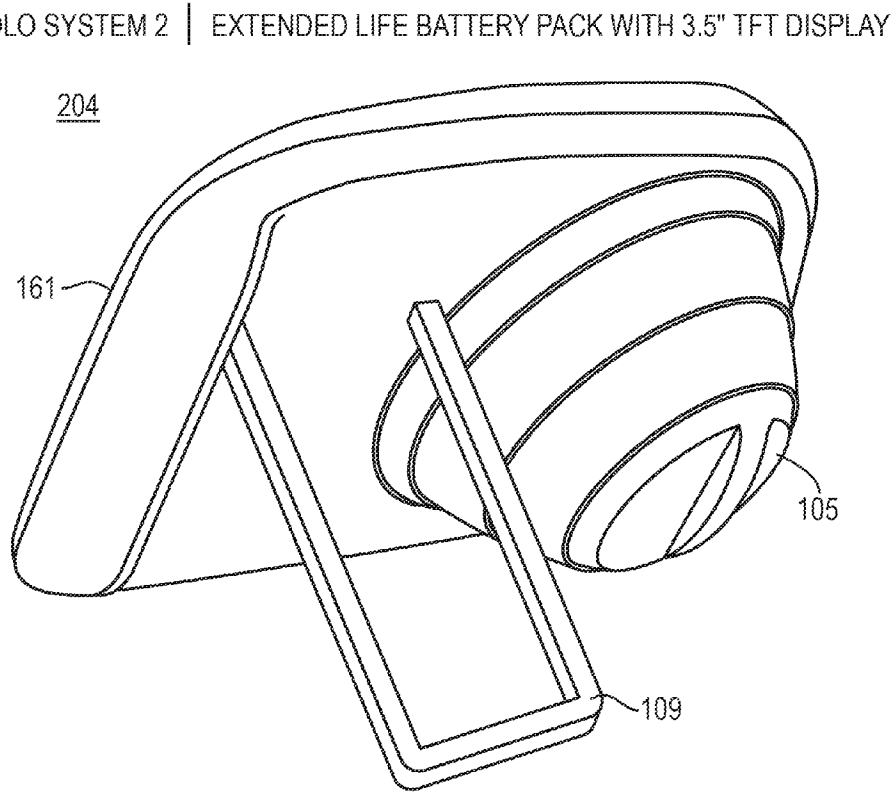
FIG. 3R is a schematic rear view of the single-speaker carrier of FIG. 3J.
Figure 3S:
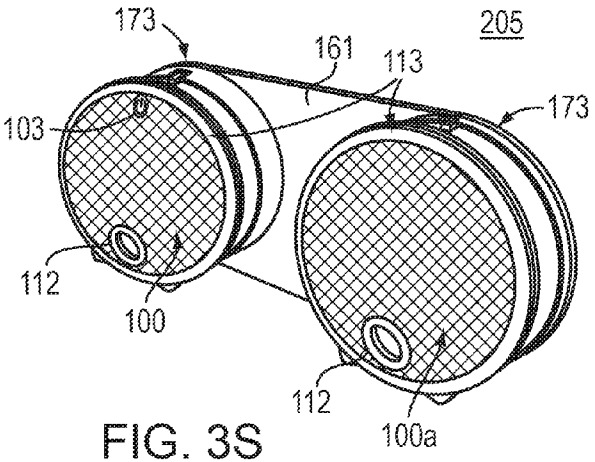
Figure 3T:
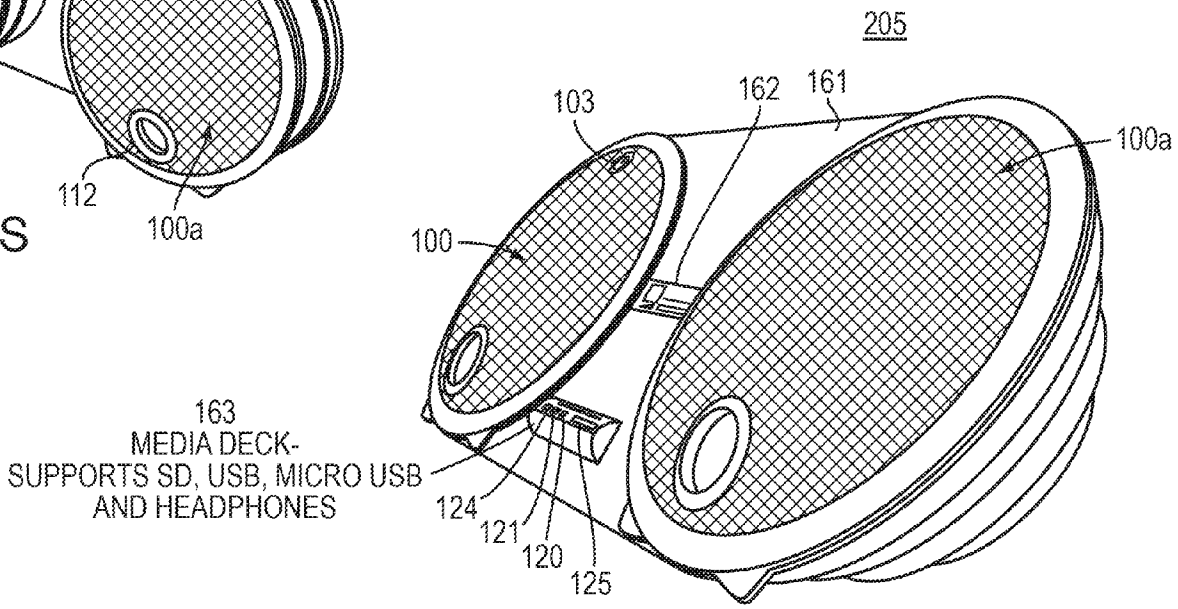
Figure 3U:
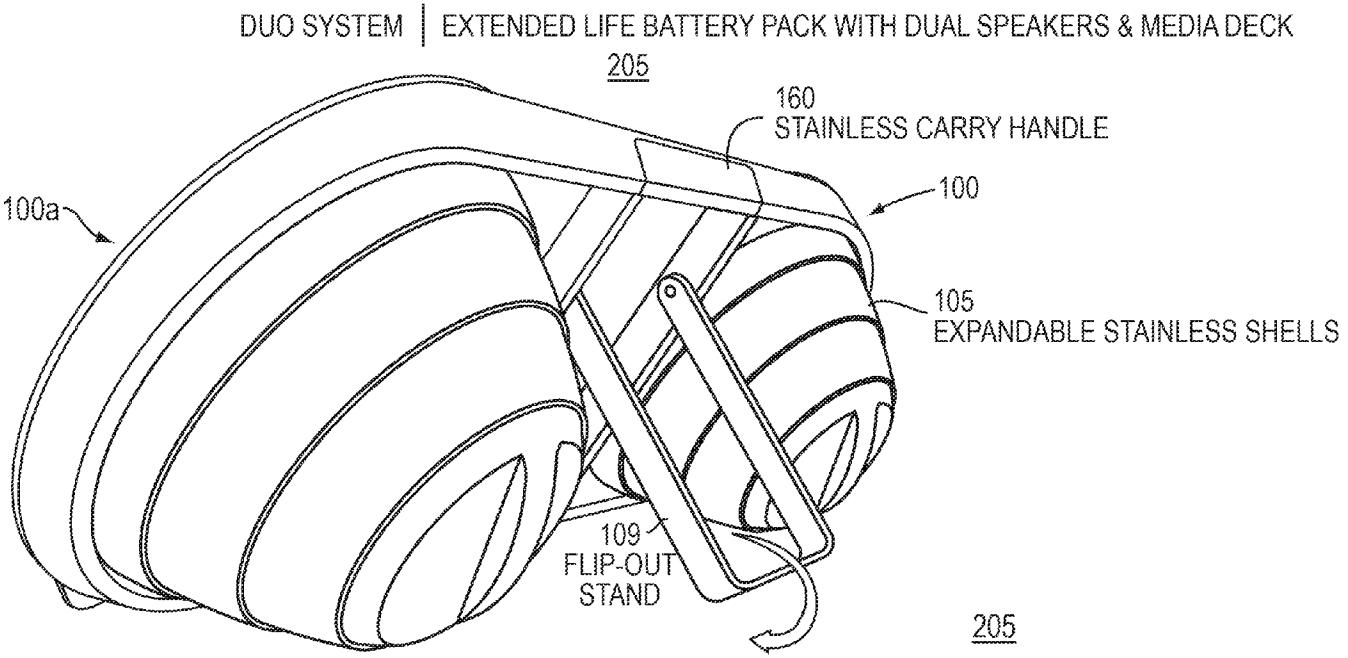
Figure 3V:
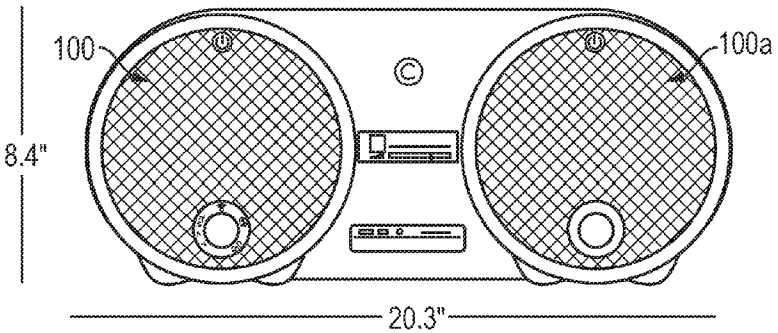
Figure 3W:
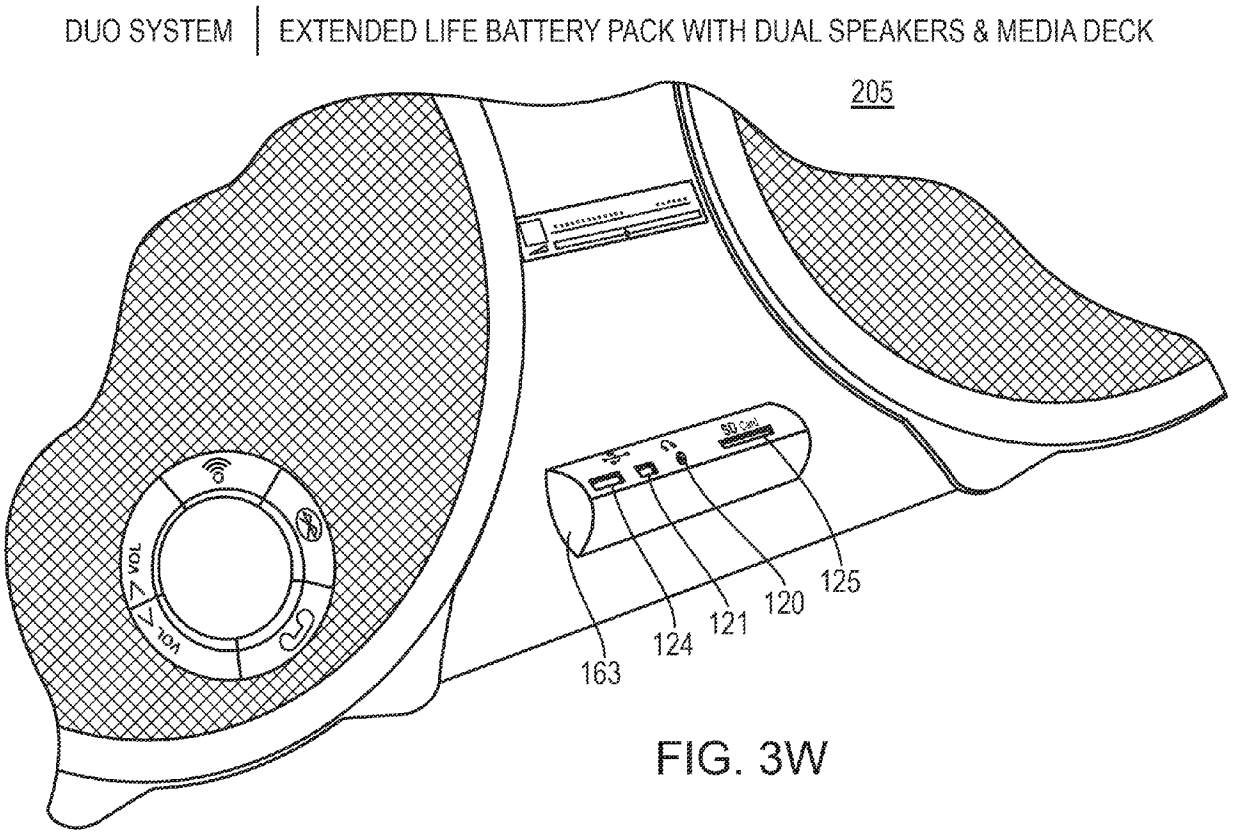

FIG. 3P is a schematic view of the port 112 that may be used at least in the speaker carriers of FIGS. 3I-3W. The speaker port 112 may include a wireless internet (e.g., WIFI) button 131 to enable and/or disable a wireless internet input to the speaker 100 based upon a user pressing the button 131 one or more times. The speaker port 112 may also include a wireless smart phone button (e.g. BLUETOOTH) 132 to enable and/or disable a wireless smart phone input to the speaker 100 based upon a user pressing the button 132 one or more times. The speaker port 112 may also include a phone sync and/or call indicator 133 that enables the speaker 100 to function as a speaker phone, while the speaker receives wireless input through a smart phone. The speaker port 112 may also include volume controls 130 to increase and/or decrease the volume of the speaker 100.

FIG. 3Q is a schematic view of the single-speaker carrier 204 of FIG. 3J that includes a housing 161, a radio display 162, and a speaker 100 with the above described power button 103 and port 112. FIG. 3R is a schematic rear view of the single-speaker carrier 204 of FIG. 3J which illustrates the expanded speaker chamber 105 and a carrier stand 109 to support the carrier 204 against a surface.

FIG. 3S-3W are schematic views of embodiments of the double-speaker carrier 205 of FIG. 3K. FIG. 3S is schematic view of an embodiment of the double-speaker carrier 205, illustrating multiple speakers 100, 100*a* being inserted into the carrier 205. As illustrated in FIG. 3S, each speaker 100, 100*a* may include a respective port 112. As illustrated in FIG. 3S, each speaker 100 may also include a rear audio port 113 which connects to a corresponding port 173 on the carrier 205. Each of the corresponding ports 173 on the carrier 205 in turn may connect to at least one or more of the input ports 120, 121, 124, 125 that are illustrated in FIG. 3T (FIG. 3T being a different perspective view of the carrier 205 of FIG. 3S). As illustrated in FIG. 3T, the speakers 100, 100*a* may be removably secured in the carrier 205, which may include a media deck 163 that may include a USB input 124, mini-USB input 121, auxiliary jack input 120, and/or secure digital (SD) card input 125.

As further illustrated in FIGS. 3S-3T, although one speaker 100 may have a power button 103, the additional speakers 100*a* do not require a power button 103.

FIG. 3U is a schematic rear view of the double-speaker carrier 205 of FIG. 3K that illustrates a carry handle 160 for a user to carry the carrier 205, a flip-out stand 109 which provides support against a surface, and expandable chamber shell or casing 105 for each speaker 100, 100*a*. FIG. 3V is a schematic front view of the double-speaker carrier 205 of FIG. 3K that illustrates 8.4 inch by 20.3 inch carrier dimensions, although the double-speaker carrier 205 is not so limited in its dimensions. FIG. 3W is a zoomed-in view of the double-speaker carrier 205 of FIG. 3K that provides an expanded view of the media deck 163 which may include a USB input 124, mini-USB input 121, auxiliary jack input 120, and/or SD card input 125.

Figure 4A:
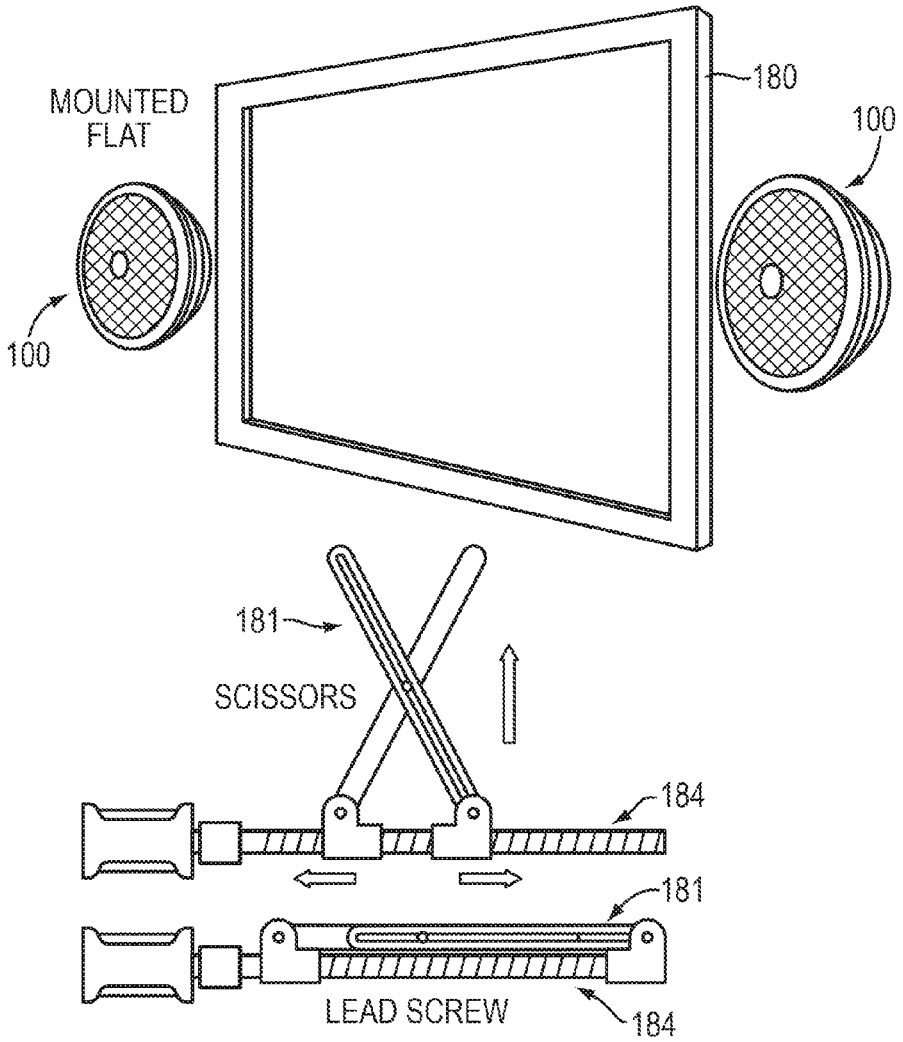
FIG. 4A is an exploded view illustration of a flat wall mount embodiment with scissor-type brackets for implementing expansion and collapsing of the speakers.
Figure 4B:
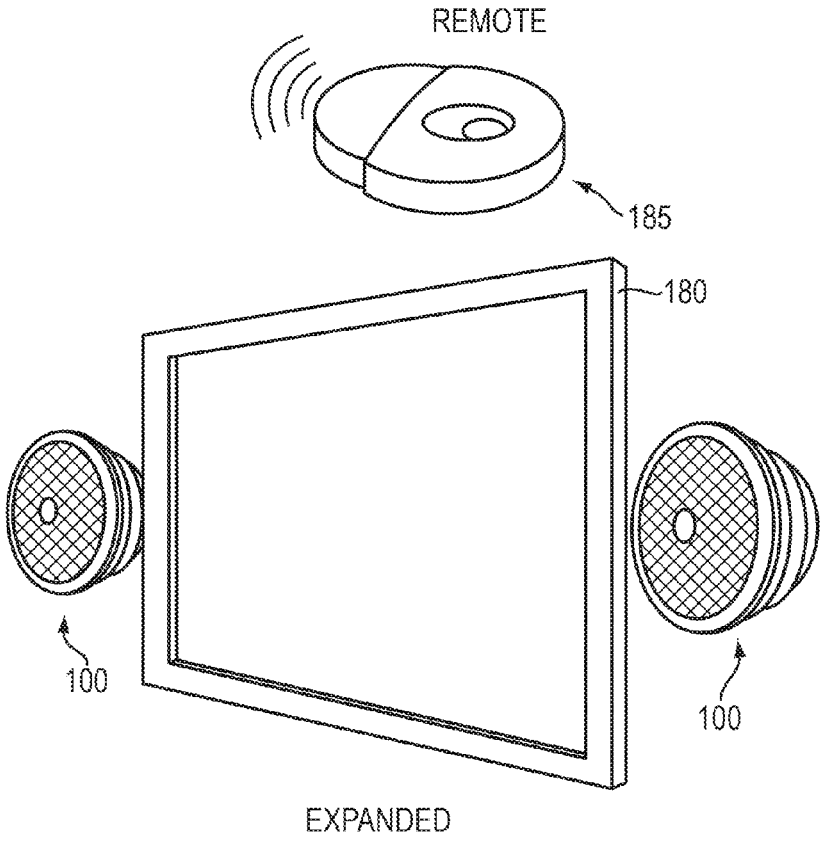
FIG. 4B is a schematic view illustration of the flat wall mount embodiment of FIG. 4A with expanded speakers and a remote control.

FIGS. 4A-4B are a schematic illustration of a flat wall mount embodiment with scissor-type brackets for implementing expansion and collapse of the speakers 100. FIG. 4A is a schematic view illustrating a multi-speaker flat wall mount embodiment. In this embodiment, each speaker 100 is located at opposing sides of a television 180, and respective scissor-type brackets 181 have a lead screw 184 implement expansion and collapse of each of the speakers 100.

FIG. 4B is a schematic view illustration of the flat wall mount embodiment of FIG. 4A with each speaker 100 expanded. FIG. 4B also illustrates a remote control 185. In an embodiment, a user may trigger the remote control 185 (through the user selecting and/or pressing one or more remote control buttons/actuators, or the user selecting and/or completing one or more sequences of pressing one or more remote control buttons/actuators), which may cause the remote control 185 to provide a wireless signal to each of the scissor brackets 181. In an embodiment, the user may select the expansion and collapse of the speakers via pressing a button or buttons of the remote control 185, and the remote control 185 wirelessly activates or otherwise operates the scissor brackets 181 (which may operate electro-mechanically or through other means) accordingly based upon the user interaction. In other words, in an embodiment, each speaker 100 may perform the at least one expanding and collapsing of itself based on (direct and/or indirect) communication from a wireless device and/or remote control 185 operated by the user. In addition, through the wireless device and/or remote control 185, the user may selectably operate the speaker by selectively enabling and/or disabling speaker power, volume, and/or speaker audio signals.

Figure 5C:
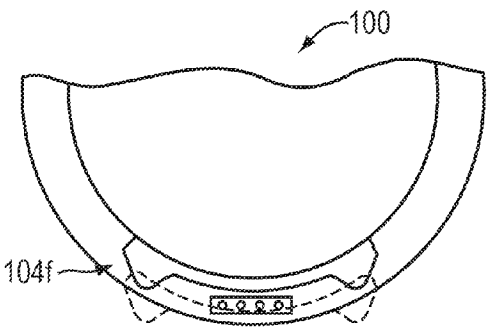
FIGS. 5A-5C are schematic views of a speaker embodiment with retractable feet (stand).
Figure 5B:
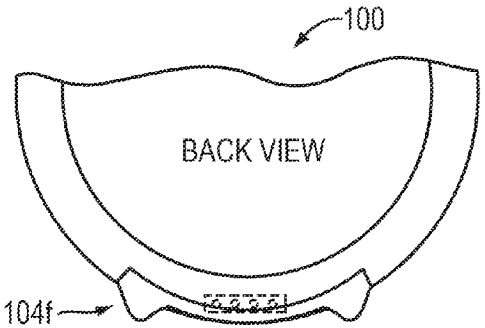
Figure 5A:
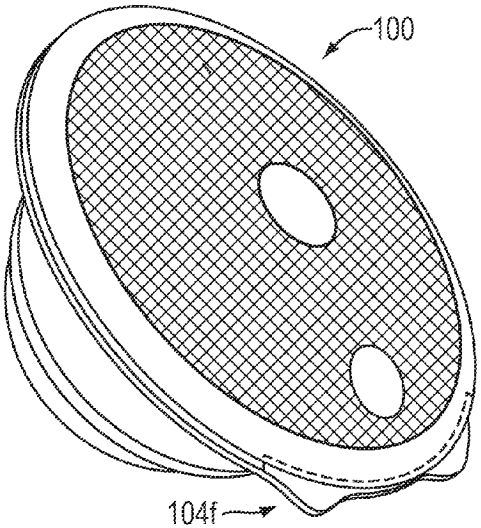

FIGS. 5A-5C present schematic views of a speaker embodiment with retractable feet (or stand) 104*f*. FIG. 5A presents a schematic front view of a speaker 100 embodiment with retractable feet (stand) 104*f*. FIG. 5B presents a schematic rear view of the speaker embodiment of FIG. 5A with the retractable feet (stand) 104*f* in an extended position (down). FIG. 5C presents a schematic rear view of the speaker embodiment of FIG. 5A with the retractable feet (stand) 104*f* in a retracted position (up). For example, the speaker 100 with feet (stand) 104*f* retracted and chamber 105 in a collapsed state is identical suitable for storage and/or travel (i.e. is portable). The speaker 100 with feet (stand) 104*f* extended and chamber 105 expanded is suitable for operation with sound generating means, such as but not limited to a radio, a television, a computer, a music player, and so forth.

The apparatus may be used alone or in various combinations whether self-contained or contained in holders or as part of existing electronic devices such as tablet computers and smart phones to provide enhanced sound (acoustic) quality by selectably expanding the chamber body 105 of the speaker.

One embodiment provides wall mounted expandable/collapsible speakers. The wall mounted speakers may lay flat (against the wall) adjacent to a wall mounted flat panel TV for non-limiting example. A remote control (wireless connection) activates expansion (collapse) of the wall mounted speakers. Other activation systems, manual or electro-mechanical, are suitable. FIGS. 4A-4B are illustrative.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A speaker comprising:

a device that converts electronic signals to audible sound; and a chamber attached to the device, the chamber geometrically configured to control acoustical qualities of the audible sound, the chamber further configured structurally to perform at least one of selectively expanding and selectively collapsing, wherein the chamber in a selectively expanded state provides an enclosed volume that enhances acoustic qualities of the audible sound, wherein the enclosed volume is defined by walls of the chamber in the selectively expanded state, the walls providing a bulb-like shape having a continuously curved surface, and the walls being formed of a plurality of portions, each of adjacent portions of the plurality having non-stepped transitions between the adjacent portions, and each of the adjacent portions collectively forming the continuously curved surface and the bulb-like shape of the chamber walls.

2. The speaker of claim 1 wherein the chamber is constructed of a material that enables the chamber to perform the at least one of selectively expanding and selectively collapsing.

3. The speaker of claim 2 wherein the material is a flexible material.

4. The speaker of claim 3 wherein the flexible material includes at least one of the following: elastomer material, thermo plastic elastomer, rubber, silicon, and formed eva.

5. The speaker of claim 1 wherein an expandable portion of the chamber is constructed of a plurality of portions of flexible material, and a plurality of portions of rigid material that telescopically slide one into the other.

6. The speaker of claim 1 wherein the chamber is constructed of rigid materials that telescopically slide one into the other.

7. The speaker of claim 6 wherein the rigid materials include at least one of metal and stainless steel.

8. The speaker of claim 1 wherein the chamber is constructed of concentric bands of rigid material that concentrically slide one into the other.

9. The speaker of claim 8 wherein the concentric bands of rigid material are combined with flexible seams made of flexible material that enables the areas between concentric bands to fold in a fashion that permits the chamber to perform the at least one of selectively expanding and selectively collapsing.

10. The speaker of claim 9 wherein the flexible material includes at least one of the following: elastomer material, thermo plastic elastomer, rubber, silicon, and formed eva.

11. The speaker of claim 1 wherein expanding the chamber modifies the audible sound by comparison with the audible sound when the chamber is not expanded.

12. The speaker of claim 1 wherein collapsing the chamber modifies the audible sound by comparison with the audible sound when the chamber is not collapsed.

13. The speaker of claim 1 wherein the speaker performs the at least one of selectively expanding and selectively collapsing in response to communication from a wireless device.

14. The speaker of claim 1 wherein the speaker performs the at least one of selectively expanding and selectively collapsing in response to at least one of the following: communication from a device wired to the speaker and a user manually manipulating the chamber.

15. An audio speaker apparatus including:

a device that converts electronic signals to audible sound; and a chamber attached to the device, the chamber geometrically configured to control acoustical qualities of the audible sound, the chamber further configured structurally to perform at least one of selectively expanding and selectively collapsing, wherein the chamber in a selectively expanded state provides an enclosed volume that enhances acoustic qualities of the audible sound, wherein the enclosed volume is defined by walls of the chamber in the selectively expanded state, the walls providing a bulb-like shape having a continuously curved surface, and the walls being formed of a plurality of portions, each of adjacent portions of the plurality having non-stepped transitions between the adjacent portions and each of the adjacent portions collectively forming the continuously curved surface and the bulb-like shape of the chamber walls.

16. The audio speaker apparatus of claim 15 wherein the chamber is constructed of a material that enables the chamber to perform the at least one of selectively expanding and selectively collapsing.

17. The audio speaker apparatus of claim 15 wherein the chamber is constructed of at least one of the following: flexible material and rigid material.

18. The audio speaker apparatus of claim 17 wherein the flexible material includes at least one of the following: elastomer material, thermo plastic elastomer, rubber, silicon, and formed eva.

19. The audio speaker apparatus of claim 15 wherein the chamber is constructed of rigid materials that telescopically slide one into the other.

20. An acoustic system for reproducing sound, comprising:

a device that converts electronic signals to audible sound; and a chamber attached to the device, the chamber geometrically configured to control acoustical properties of the audible sound, the chamber further configured structurally to perform at least one of expanding and collapsing, selectably by a user, wherein the chamber in a selectively expanded state provides an enclosed volume that enhances acoustic qualities of the audible sound, wherein the enclosed volume is defined by walls of the chamber in the selectively expanded state, the walls providing a bulb-like shape having a continuously curved surface, and the walls being formed of a plurality of portions, each of adjacent portions of the plurality having non-stepped transitions between the adjacent portions and each of the adjacent portions collectively forming the continuously curved surface and the bulb-like shape of the chamber walls.

21. The acoustic system of claim 20 wherein the chamber is constructed of a material that enables the chamber to perform the at least one of expanding and collapsing.

22. The acoustic system of claim 20 wherein the chamber is constructed of at least one of the following: flexible material and rigid material.

23. The acoustic system of claim 22 wherein the flexible material includes at least one of the following: elastomer material, thermo plastic elastomer, rubber, silicon, and formed eva.

24. The acoustic system of claim 20 wherein the chamber is constructed of rigid materials that telescopically slide one into the other.

25. The speaker of claim 1 wherein the chamber in the selectively expanded state modifies the audible sound by comparison with the audible sound when the chamber is not in the selectively expanded state, and the chamber in the selectively expanded state further enhances resonance of sound waves of the audible sound, and efficiency of the speaker.

26. The speaker of claim 1 wherein the enclosed volume is further defined by a curved geometry of the walls of the chamber in the selectively expanded state, the walls having a smooth surface.

27. The speaker of claim 1 wherein the geometric configuration of the chamber includes at least one of: a cone geometry, a funnel geometry, a conic geometry, a conical geometry, and a conoid geometry.

28. The speaker of claim 1 wherein each transition between the adjacent portions is a smooth transition.

* * * * *